US008534193B2

(12) United States Patent
Tsai

(10) Patent No.: US 8,534,193 B2
(45) Date of Patent: Sep. 17, 2013

(54) CLEANING APPARATUS FOR PRINTER

(75) Inventor: Ping-Fang Tsai, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 67 days.

(21) Appl. No.: 13/268,033

(22) Filed: Oct. 7, 2011

(65) Prior Publication Data

US 2012/0272849 A1 Nov. 1, 2012

(30) Foreign Application Priority Data

Apr. 29, 2011 (TW) ..... 100115060 A

(51) Int. Cl.
*B41F 35/00* (2006.01)

(52) U.S. Cl.
USPC ..... 101/425; 101/423

(58) Field of Classification Search
USPC ..... 101/425
See application file for complete search history.

(56) References Cited

U.S. PATENT DOCUMENTS

| | | | | |
|---|---|---|---|---|
| 3,505,699 | A * | 4/1970 | Trumbull | 15/104.001 |
| 4,407,219 | A * | 10/1983 | Dellevoet | 118/60 |
| 7,004,460 | B2 * | 2/2006 | Ruhe et al. | 271/113 |
| 7,356,302 | B2 * | 4/2008 | Yamamoto | 399/388 |
| 7,391,992 | B2 * | 6/2008 | Inoue | 399/123 |
| 7,677,556 | B2 * | 3/2010 | Murayama et al. | 271/162 |
| 7,980,548 | B2 * | 7/2011 | Sonoda et al. | 271/117 |
| 8,162,310 | B2 * | 4/2012 | Sunohara | 271/109 |
| 2006/0197276 | A1 * | 9/2006 | Tanaka | 271/118 |
| 2007/0222136 | A1 * | 9/2007 | Murakami | 271/9.09 |

* cited by examiner

*Primary Examiner* — Anthony Nguyen
(74) *Attorney, Agent, or Firm* — Altis Law Group, Inc.

(57) ABSTRACT

A cleaning apparatus for a printer, includes a bracket and a paper transmitting apparatus. The bracket includes a paper tray which is adapted to receive a paper located on. The paper tray defines a cutout. A brush is pivotably mounted below the cutout. The brush is covered by any paper in the paper tray, and is exposed through the cutout when there is no paper in the paper tray. The paper transmitting apparatus includes a carrier and a roller rotatablely mounted on the carrier The paper transmitting apparatus rotates the roller to move the paper in the paper tray. The roller can rotate against the brush when the paper tray is empty to be cleaned of any paper scraps.

13 Claims, 7 Drawing Sheets

CLEANING APPARATUS FOR PRINTER

BACKGROUND

1. Technical Field

The present disclosure relates to a cleaning apparatus, more particularly to a cleaning apparatus for cleaning paper scrap in a printer.

2. Description of Related Art

Printers are widely used to produce documents. However, papers usually have a plurality of paper scraps attached thereon. When the papers are transmitted in a printer, the plurality of paper scraps is left on paper transmitting mechanisms of the printer. The paper scraps may generate static current in the paper transmitting mechanisms.

Therefore, there is room for improvement within the art.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
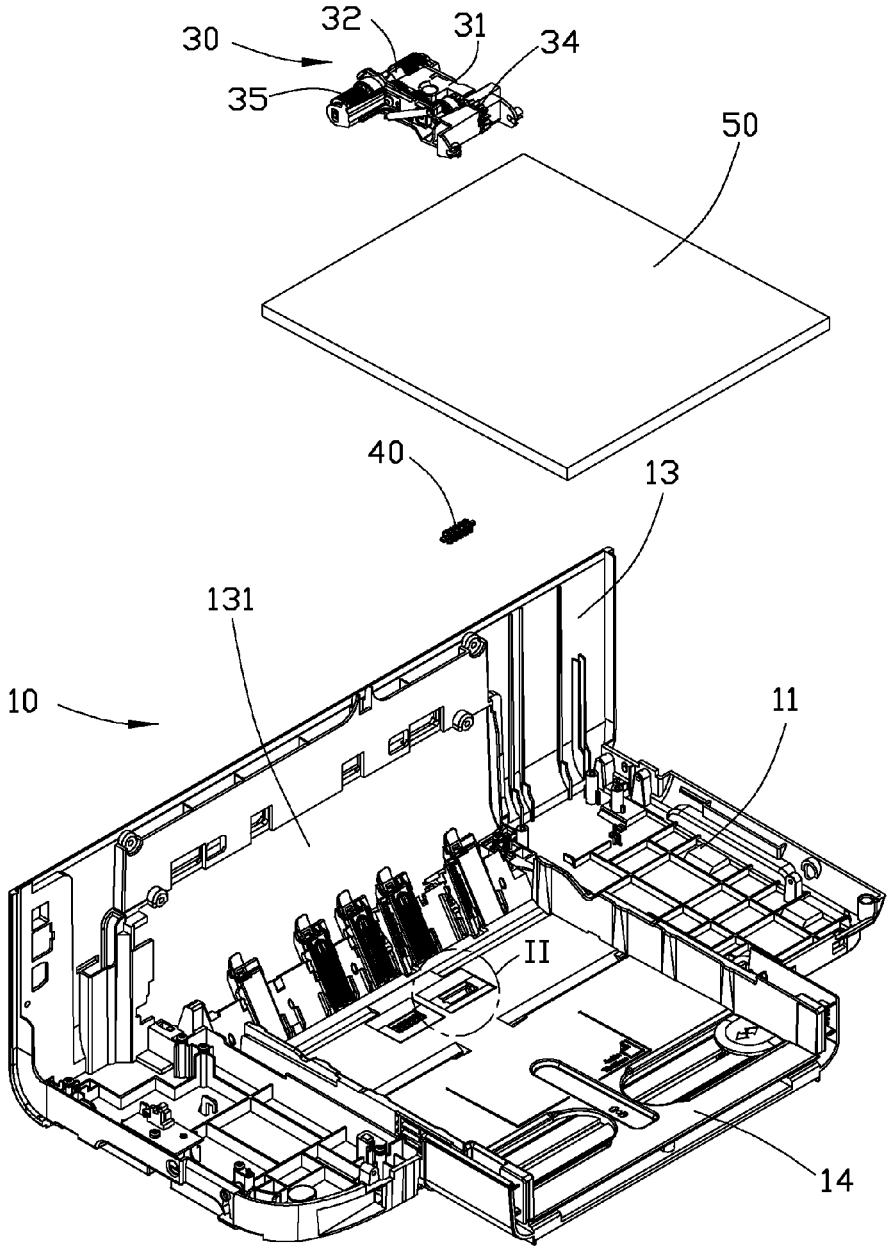
FIG. 1 is an exploded and isometric view of an embodiment of a cleaning apparatus for a printer.

Referring to FIG. 1, a cleaning apparatus for a printer includes a bracket 10 and a paper transmitting apparatus 30. The bracket 10 is mounted on a printer.

Figure 2:
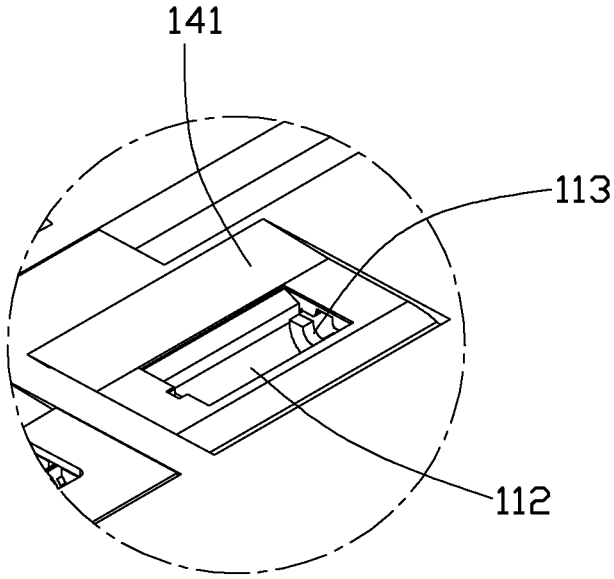
FIG. 2 is an enlarged view of a circled portion II of FIG. 1.

Referring to FIGS. 1 and 2, the bracket 10 includes a first board 11 and a second board 13 perpendicular to the first board 11. A paper tray 14 is mounted on the first board 11. A plurality of papers 50 is located on the paper tray 14. The second board 13 defines an opening 131. The opening 131 is aligned with the paper tray 14. The paper tray 14 defines a pair of cutouts 141. The first board 11 defines a pair of receiving rooms 112 corresponding to the pair of cutouts 141. The receiving rooms 112 are located below and aligned with the cutouts 141. Two sides of each receiving room 112 define a pair of pivot holes 113. Each receiving room 112 can receive a brush 40 therein.

Figure 3:
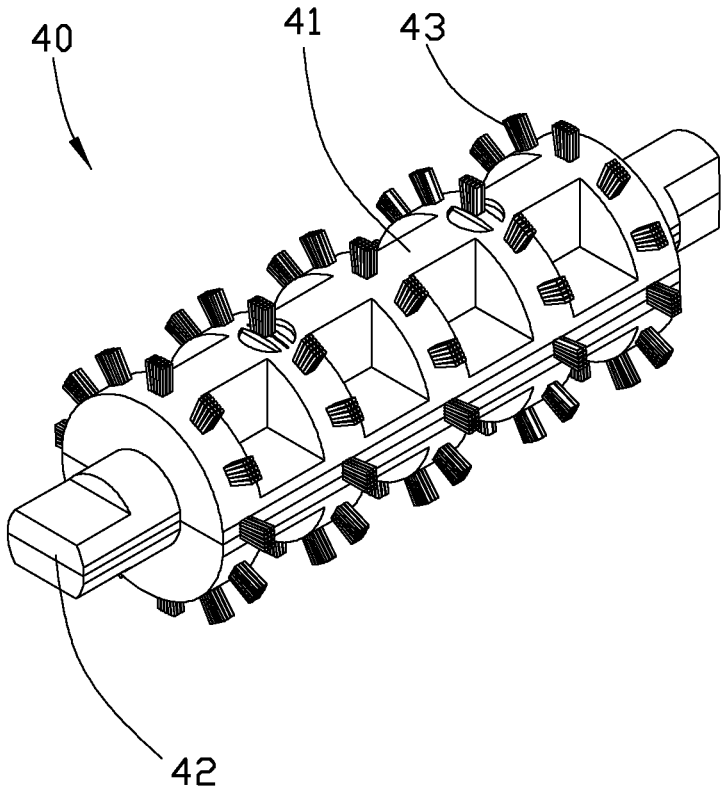
FIG. 3 is an isometric view of a brush of the cleaning apparatus of FIG. 1.
Figure 4:
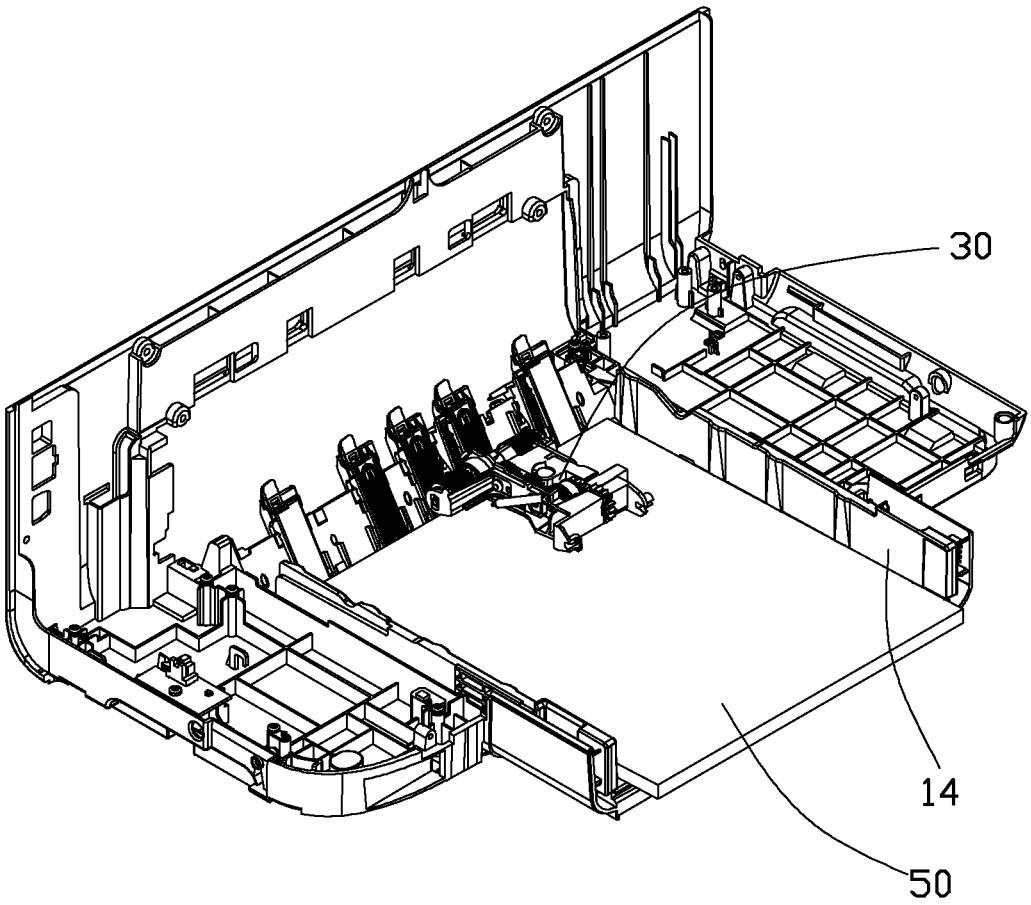
FIG. 4 is a first assembly view of the cleaning apparatus of FIG. 1.
Figure 5:
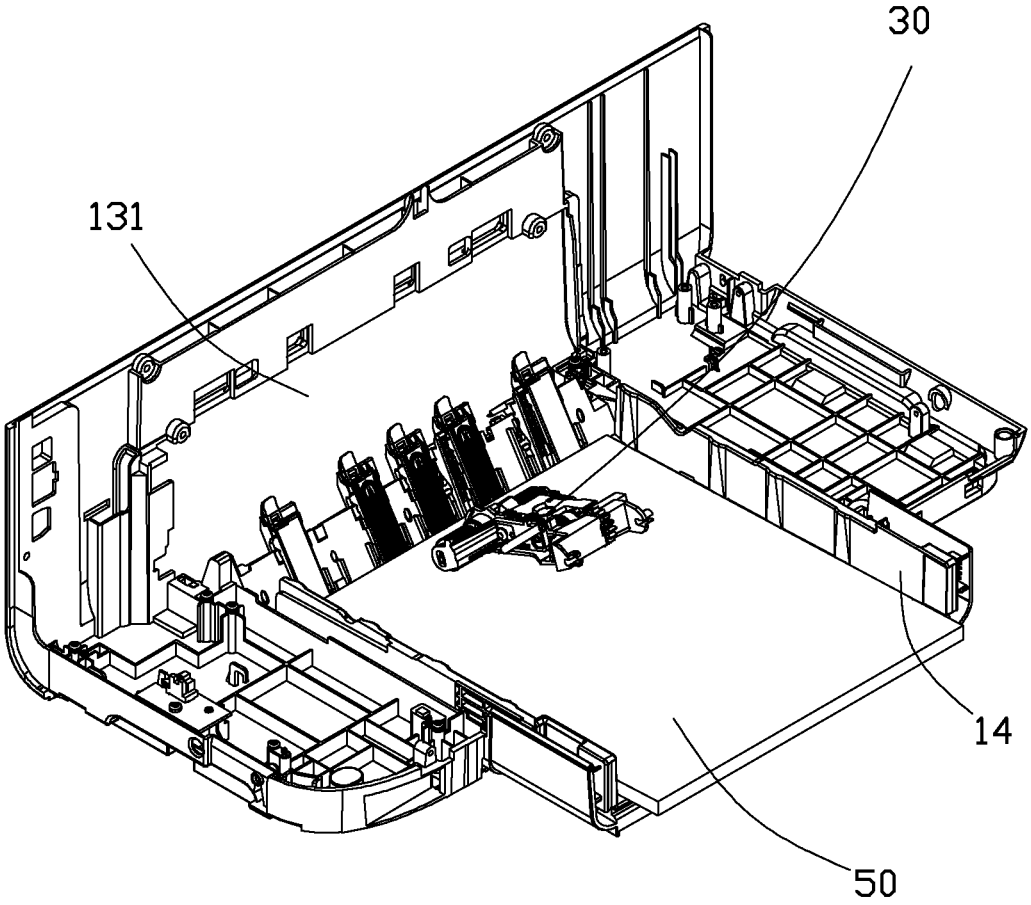
FIG. 5 is a second assembly view of the cleaning apparatus of FIG. 1.
Figure 6:
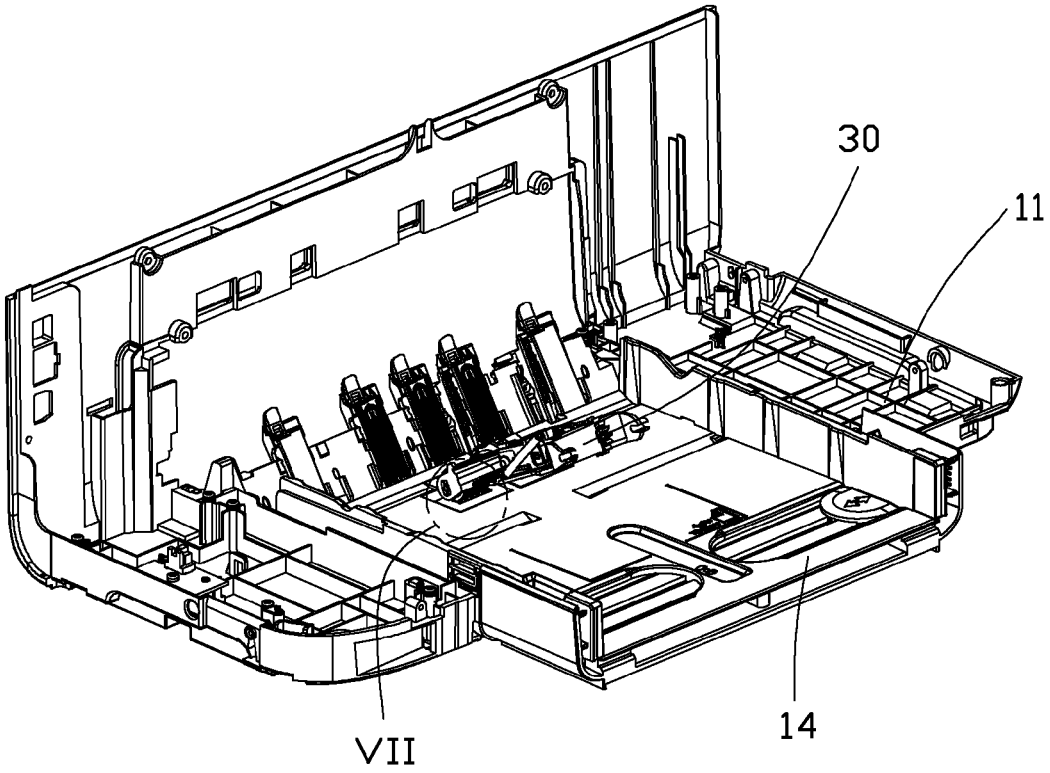
FIG. 6 is a third assembly view of the cleaning apparatus of FIG. 1.
Figure 7:
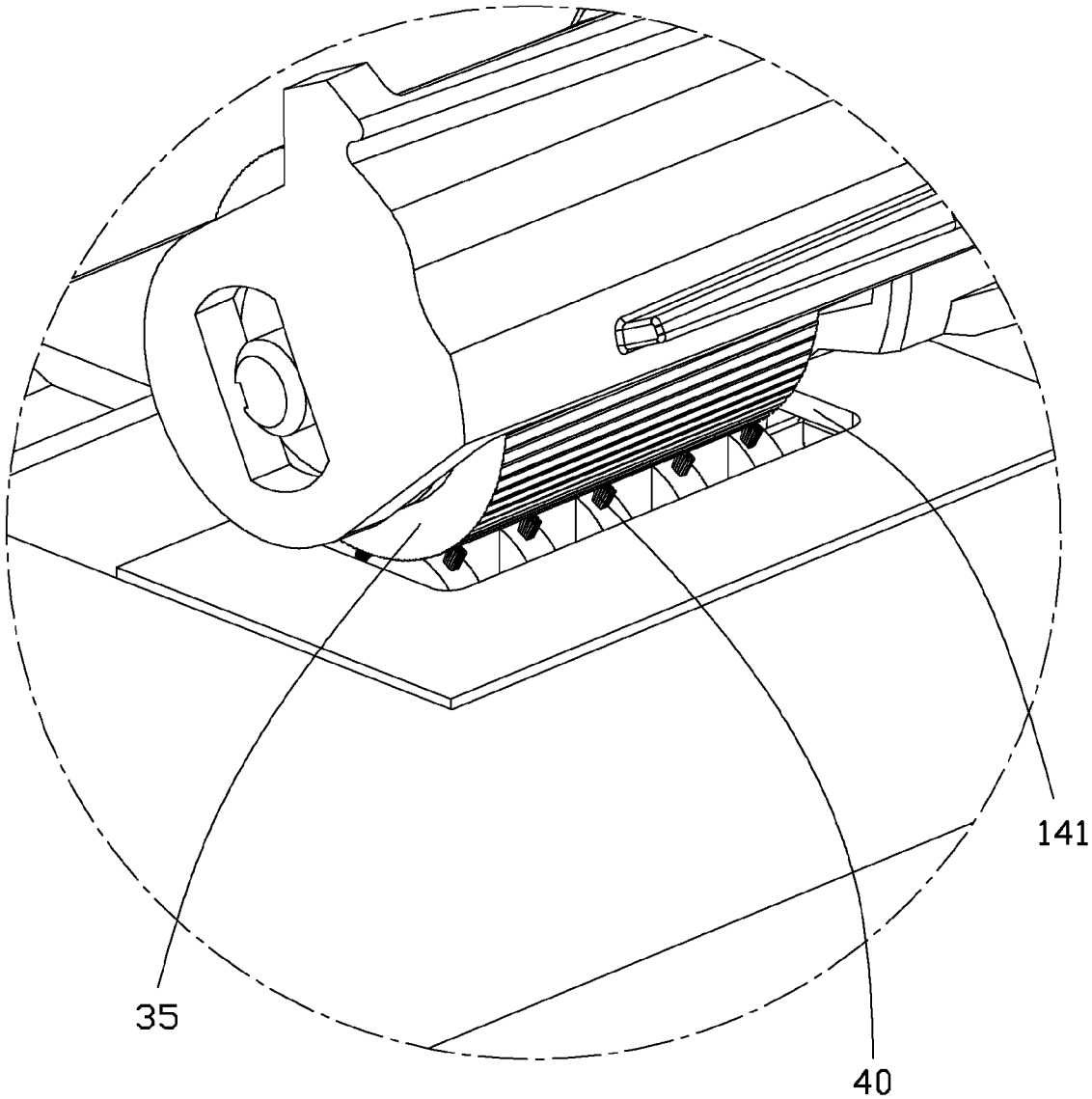
FIG. 7 is an enlarged view of the circle VII of FIG. 6.

Referring to FIG. 3, the brush 40 includes a columnar main body 41. A pair of pivot pins 42 is formed on two ends of the main body 41. A plurality of bristles 43 is secured on the main body 41.

Referring to FIG. 1, the paper transmitting apparatus 30 includes a carrier 31. A rear portion of the carrier 31 is pivotably mounted on the printer. A roller 32 is pivotably mounted on a front portion of the carrier 31. Two sleeves 35 are fit on the roller 32. Outer surfaces of the sleeves 35 are rough. A motor (not shown) is mounted on the paper transmitting apparatus 30. A plurality of gears 34 is linked between the roller 32 and the motor. The motor rotates the roller 32 via the gears 34. The sleeves 35 rotate together with the roller 32.

Referring to FIGS. 1 to 7, in assembly of the cleaning apparatus, the brush 40 is placed in the receiving room 112. The pivot pins 42 are received in the pivot holes113 to mount the brush 40 in the receiving room 112. Then, the rear portion of the carrier 31 is pivotably mounted on the printer. The paper transmitting apparatus 30 rotates on the printer between a first position and a second position. In the first position, the roller 32 is located above the paper tray 14 and does not contact with the paper tray 14. In the second position, the sleeves 35 of the roller 32 are aligned with the cutouts 141.

When the paper transmitting apparatus 30 is positioned in the second position, if there is a paper 50 located on the paper tray 14, the sleeves 35 come in contact with the paper 50. To move the paper 50, the motor rotates the roller 32. The sleeves 35 rotate to bring the paper 50 slide on the paper tray 14. Paper scraps of the paper 50 are left on the sleeves 35. The paper 50 slides in the opening 131 to move in the printer. If there is not a paper 50 located on the paper tray 14, the sleeves 35 rotate against the bristles 43 to be cleaned of any paper scraps.

It is to be understood, however, that even though numerous characteristics and advantages of the embodiments have been set forth in the foregoing description, together with details of the structure and functions of the embodiments, the disclosure is illustrative only, and changes may be made in detail, especially in the matters of shape, size, and arrangement of parts within the principles of the invention to the full extent indicated by the broad general meaning of the terms in which the appended claims are expressed.

What is claimed is:

1. A cleaning apparatus for a printer, comprising:

a bracket comprising a paper tray mounted thereon, the paper tray adapted to receive a paper located on; the paper tray defining a cutout, a brush pivotably mounted below the cutout, the brush adapted to be shielded by the paper when the paper is located on the paper tray, and the brush adapted to be exposed via the cutout when the paper is not located on the paper tray; and a paper transmitting apparatus comprising a carrier and a roller rotatablely mounted on the carrier, the paper transmitting apparatus adapted to rotate the roller to contact the paper and move the paper on the paper tray when the paper is located on the paper tray, and the roller adapted to rotate against the brush to clean the roller when the paper is not located on the paper tray.

2. The cleaning apparatus of claim 1, wherein the bracket defines a receiving room below the cutout, and the brush is received in the receiving room.

3. The cleaning apparatus of claim 2, wherein two sides of the receiving room define a pair of pivot holes, a pair of pivot pins is located on two ends of the brush, and the pair of pivot pins is received in the pair of pivot holes.

4. The cleaning apparatus of claim 3, wherein the brush comprises a main body located between the pair of pivot pins, and a plurality of bristles is secured on the main body.

5. The cleaning apparatus of claim 1, wherein the paper transmitting apparatus is adapted to move between a first position and a second position; in the first position, the roller is located above the paper tray and does not contact the paper tray; and in the second position, the roller is aligned with the cutout and contacts the paper or the brush.

6. The cleaning apparatus of claim 5, wherein a sleeve is put around the roller, and outer surfaces of the sleeve are rough.

7. The cleaning apparatus of claim 1, wherein the bracket comprises a first board and a second board approximately perpendicular to the first board, the second board defines an opening, the opening is aligned to the paper tray, and the opening is adapted to allow the paper pass therethrough when the paper is moved on the paper tray.

8. A cleaning apparatus for a printer, comprising:

a bracket comprising a first board and a second board approximately perpendicular to the first board, a paper tray mounted on the first board, the second board defining an opening which is aligned to the paper tray, the paper tray defining a cutout, a brush mounted below the cutout and located above the first board, the paper tray adapted to receive a paper located on; the brush adapted to be shielded by the paper when the paper is located on the paper tray, and the brush adapted to be exposed via the cutout when the paper is not located on the paper tray; and a roller adapted to rotate to contact the paper and move the paper through the opening when the paper is located on the paper tray, and the roller adapted to rotate against the brush to clean the roller when the paper is not located on the paper tray.

9. The cleaning apparatus of claim 8, wherein the bracket defines a receiving room below the cutout, and the brush is received in the receiving room.

10. The cleaning apparatus of claim 9, wherein two sides of the receiving room define a pair of pivot holes, a pair of pivot pins is located on two ends of the brush, and the pair of pivot pin is received in the pair of pivot holes.

11. The cleaning apparatus of claim 10, wherein the brush comprises a main body located between the pair of pivot pins, and a plurality of bristles is secured on the main body.

12. The cleaning apparatus of claim 8, wherein the roller is rotatablely mounted on a paper transmitting apparatus, the paper transmitting apparatus is adapted to move between a first position and a second position; in the first position, the roller is located above the paper tray and does not contact the paper tray; and in the second position, the roller is aligned with the cutout and contacts the paper or the brush.

13. The cleaning apparatus of claim 12, wherein a sleeve is put around the roller, and outer surfaces of the sleeve are rough.

* * * * *